US005855499A

United States Patent [19]

Yamazaki et al.

[11] Patent Number: 5,855,499

[45] Date of Patent: Jan. 5, 1999

[54] PACKAGING APPARATUS MOUNTING A DISPLAYED ARTICLE USING A COMPONENT OF THE ARTICLE

[75] Inventors: Noboru Yamazaki; Hisanori Kijima, both of Sizuoka, Japan

[73] Assignee: Kabushiki Kaisha Bandai, Japan

[21] Appl. No.: 814,156

[22] Filed: Mar. 10, 1997

Related U.S. Application Data

[63] Continuation of Ser. No. 495,041, Jun. 27, 1995, abandoned.

[51] Int. Cl.[6] ..... A63H 3/00

[52] U.S. Cl. ..... 446/73; 446/79; 446/268

[58] Field of Search ..... 446/72, 73, 75, 446/77, 79, 97, 98, 101, 268; 206/470, 476, 560, 575, 579

[56] References Cited

U.S. PATENT DOCUMENTS

| | | | |
|---|---|---|---|
| 1,670,204 | 5/1928 | Moore | 206/476 |
| 1,804,927 | 5/1931 | Gilbert | 446/75 |
| 2,884,739 | 5/1959 | Ketcham | 446/390 |
| 3,232,420 | 2/1966 | Haenle | 206/575 |
| 3,259,236 | 7/1966 | Cole | 206/476 |
| 4,723,931 | 2/1988 | Allen et al. | 446/268 |
| 4,905,828 | 3/1990 | Dods | 446/75 |
| 5,013,278 | 5/1991 | Dixon et al. | 446/73 |
| 5,100,324 | 3/1992 | Slayton | 206/575 |
| 5,152,710 | 10/1992 | Montgomery | 446/75 |
| 5,250,000 | 10/1993 | Boutin et al. | 446/75 |

FOREIGN PATENT DOCUMENTS

| | | | |
|---|---|---|---|
| 812707 | 4/1959 | United Kingdom | 446/97 |
| 2143143 | 2/1985 | United Kingdom | 446/101 |
| 2204567 | 11/1988 | United Kingdom . | |
| 9104924 | 4/1991 | WIPO | 446/75 |

*Primary Examiner*—Robert A. Hafer
*Assistant Examiner*—Jeffrey D. Carlson
*Attorney, Agent, or Firm*—Graham & James LLP

[57] ABSTRACT

A structure for a toy comprising a doll body and parts and accessories thereof which can be safely transported without using special cushioning member or holding members such as styrene foam or cardboard stands for their packaging. There are provided a doll body 1 and a runner 2; the runner 2 integrally incorporates a back part which is attached to a portion of the doll body 1, and the back part is attached to a back portion of the doll body 1 which is integrally mounted on the runner 2 by way of a gate portions 8*a* and 8*b*.

14 Claims, 6 Drawing Sheets

PACKAGING APPARATUS MOUNTING A DISPLAYED ARTICLE USING A COMPONENT OF THE ARTICLE

This is a continuation of application Ser. No. 08/495,041 filed on Jun. 27, 1995 now abandoned.

BACKGROUND OF THE INVENTION

This invention relates to a doll toy comprising a doll body and accessories thereof.

For transportation of a doll toy made up of a doll body and separate doll body parts and accessories, cushioning members and holding members are necessary so that they do not collide and become damaged inside their packaging. Conventionally, styrene foam containers or cardboard stands or the like have been used as these cushioning members and holding members.

When styrene foam containers are used, cavities are formed therein to match the doll body and its parts and accessories, and the doll body and associated parts are positioned by being fitted into these cavities. For each type of doll body, a container having cavities corresponding to that type are prepared.

Also, when a cardboard stand is used, the doll body and associated parts are positioned by being bound to the stand with rubber bands.

With the conventional technology, when styrene foam containers are used, it has been necessary to prepare a container separate from the doll body and provided with cavities matched to the shape of the doll body and associated parts, and time and labor has been required to fit the doll body and associated parts into these cavities.

Also, for each type of doll body it has been necessary to prepare a different container having cavities matching that type of doll body.

On the other hand, when a cardboard stand is used, it has taken time and labor to bind the doll body and associated parts to the stand with rubber bands or the like.

SUMMARY OF THE INVENTION

This invention was devised in view of the above-mentioned problems, and an object of the invention is to provide structure for a doll toy comprising a doll body and parts and accessories thereof so that they can be safely transported without special cushioning members or holding members such as styrene foam packaging or cardboard stands being used.

To achieve the above-mentioned object and other objects, first means provided by the invention has the following features:

(a) there is provided a doll body and a runner;

(b) said runner integrally incorporates back part which is attached to a back portion of said doll body; and (c) said back part is integrally mounted on said runner by way of gate portions and attached to the back portion of said doll body.

To achieve the above-mentioned object and other objects, a second means provided by the invention has the following features:

(a) there is provided a doll body and a runner;

(b) said runner integrally has a back part which is attached to a back portion of the doll body;

(c) said back part is integrally mounted on said runner by way of gate portions and attached to the back portion of said doll body;

(d) through holes are provided in hands of said doll body; and (e) support parts are provided with said runner so that they can fit said through holes.

The first means provided by the invention has a doll body and a runner, and the runner integrally incorporates a back part attached to a back portion of the doll body. The back part is integrally mounted on the runner by way of gate portions, and by attaching the doll body to the back part the doll body can be positioned and held on the runner. Because the doll body is positioned and held on the runner in this way, a doll toy comprising a doll body and parts and accessories thereof can be safely transported without special cushioning members or holding members such as styrene foam packaging or cardboard stands being used.

By cutting the gate portions joining the back part to the runner, the complete doll body can be removed from the runner.

The second means provided by the invention has a doll body and a runner, and the runner integrally incorporates a back part attached to a back portion of the doll body. The back part is integrally mounted on the runner by way of gate portions, and by attaching the doll body to the back part the doll body can be positioned and held on the runner. Because the doll body is positioned and held on the runner in this way, a doll toy comprising a doll body and parts and accessories thereof can be safely transported without special cushioning members or holding members such as styrene foam packaging or cardboard stands being used.

By cutting the gate portions joining the back part to the runner, the complete doll body can be removed from the runner.

Also, by fitting the support parts formed on the runner into through holes provided in the hands of the doll body, the doll body can be held in its prescribed position on the runner.

DETAILED DESCRIPTION OF THE PREFERRED EMBODIMENTS

The invention will now be described based on a preferred embodiment thereof shown in the accompanying drawings.

First, the constitution of a preferred embodiment of the invention will be described with reference to FIG. 1 through FIG. 3

Figure 1:
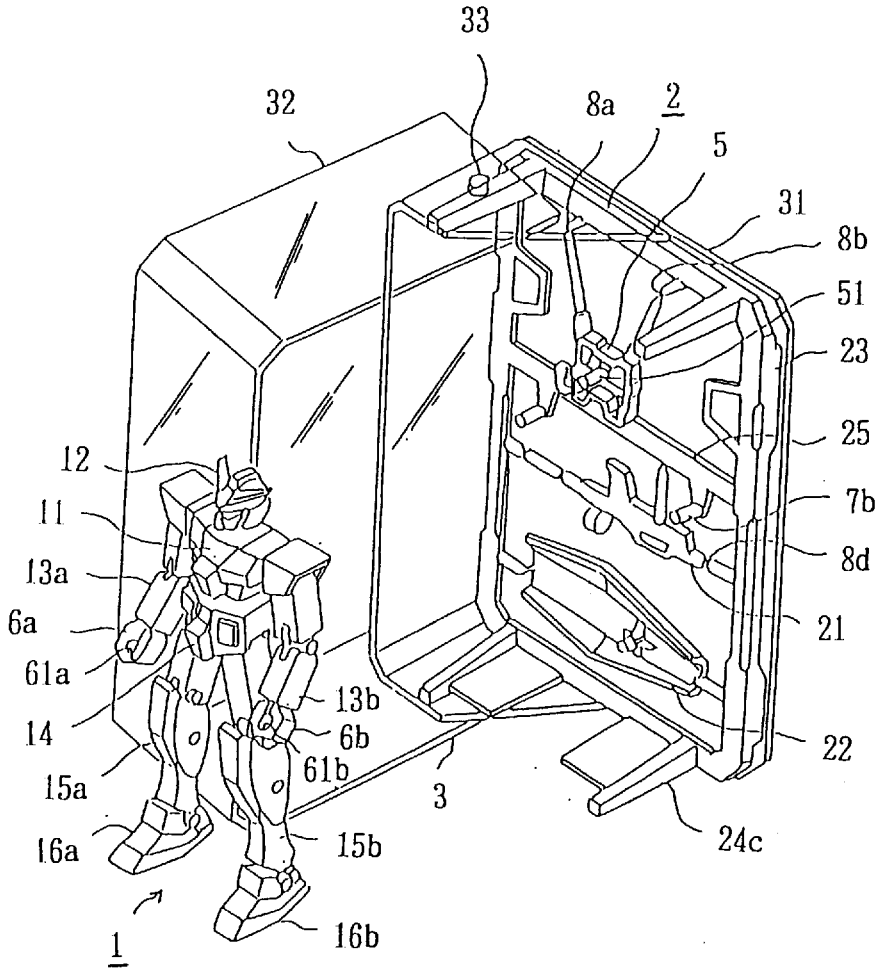
FIG. 1 is a perspective view of the overall constitution of a preferred embodiment of the invention.
Figure 2:
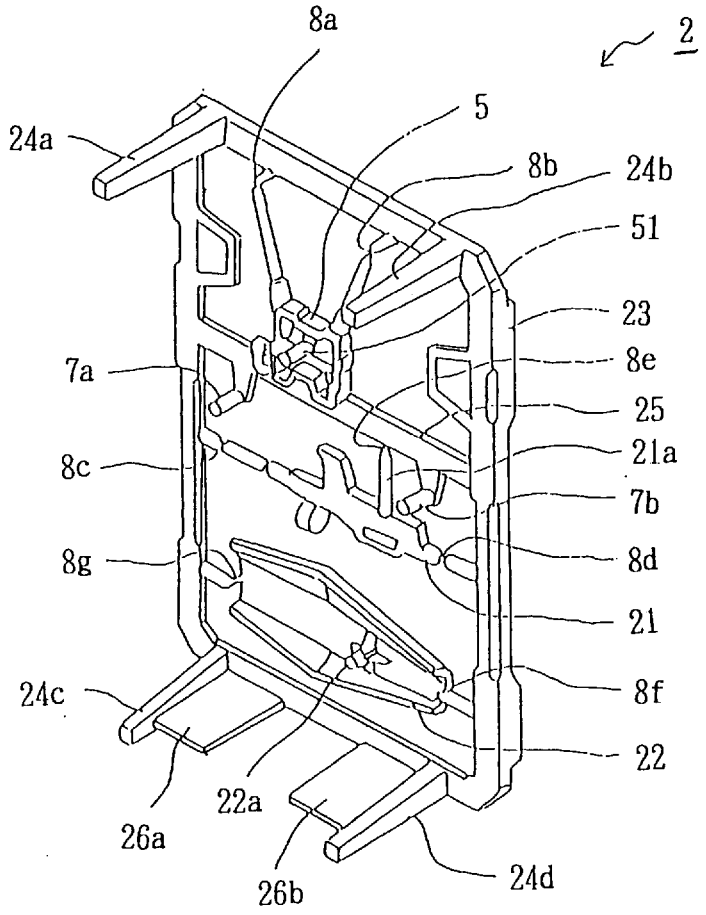
FIG. 2 is a perspective view of a runner shown in FIG. 1.

As shown in FIG. 1, a doll toy according to the invention is made up of a doll body 1, a runner 2, and a box 3 in which the doll body 1 and the runner 2 are housed.

First, the doll body 1 will be described. The doll body 1 is consists of members made of a hard synthetic resin or the like. A head part 12 and a pair of arm parts 13*a* and 13*b* are attached to a torso part 11 of the doll body 1 by way of joint parts, and hands 6*a* and 6*b* are attached to the pair of arm parts 13*a* and 13*b* respectively by way of joint parts. The interposition of these joint parts enables the head part 12, the arm parts 13*a* and 13*b* and the hands 6*a* and 6*b* to be individually pivoted or bent. Also, the pair of arm parts 13*a* and 13*b* each have an upper arm part and a lower arm part and a joint part disposed therebetween, and the interposition of these joint parts enables the lower arm parts to be independently pivoted and bent with respect to the upper arm parts.

Similarly, a waist part 14 is attached to the lower part of the torso part 11, a pair of leg parts 15*a* and 15*b* are attached to the waist part 14 by way of joint parts, and feet 16*a* and 16*b* are attached to the pair of leg parts 15*a* and 15*b* respectively by way of joint parts. The interposition of these joint parts enables the waist part 14, the leg parts 15*a* and 15*b* and the feet 16*a* and 16*b* to be individually pivoted or bent. Also, the pair of leg parts 15*a* and 15*b* each have an upper leg part and a lower leg part and a joint part disposed therebetween, and the interposition of these joint parts enables the lower leg parts to be independently pivoted and bent with respect to the upper leg parts.

Figure 3:
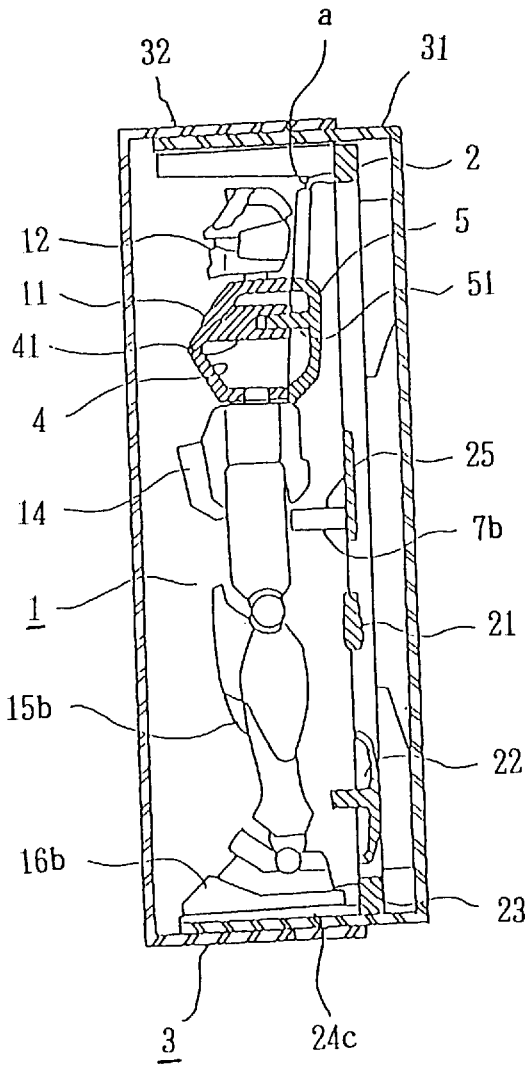
FIG. 3 is a partially sectional side view of a doll body according to the invention housed with accessories thereof in a case.

As shown in FIG. 3 in partial section, an opening 4 to eliminate distortion during molding is provided in the back side of the torso part 11, and a boss 41 is provided inside the opening 4. This boss 41 is provided with a fitting hole into which fits a projecting portion of a part which will be further discussed later.

The hands 6*a* and 6*b* are each formed like a clenched fist and have through holes 61*a* and 61*b* provided in their centers.

Next, the runner 2 will be described. The runner 2 is made up of members made of a hard synthetic resin or the like, and as shown in FIG. 2 has a frame 23 and pillars 24*a*, 24*b*, 24*c* and 24*d* projecting to a predetermined height from the four corners of the frame 23. A plurality of parts 5, 21 and 22 and a cross-plate 25 are provided integrally with the frame 23.

The part 5 is attached to the frame 23 by way of gate portions 8*a*, 8*b*. Any number of gate portions may be used. These gate portions 8*a*, 8*b* are formed as part of the same member as the part 5 and are thin and narrow and can therefore be easily cut. As a result, by cutting these gate portions 8*a*, 8*b* it is possible to easily remove the part 5 from the frame 23. A projection 51 is provided roughly in the center of the part 5. This projection 51 is disposed in a position corresponding to the opening 4 in the doll body 1, and fits into the fitting hole provided in the boss 41 inside the opening 4.

Similarly, a part 21 shaped like a machine gun is attached to the runner by way of gate portions 8*c*, 8*d* and 8*e*, and a part 22 shaped like a shield is attached by way of gate portions 8*f* and 8*g*. The part 21 is provided with a mating projection 21*a*, and the part 22 is provided with a mating projection 22*a*. The mating projection 21*a* and the mating projection 22*a* can be fitted into the through holes 61*a* and 61*b* in the hands 6*a* and 6*b* of the doll body 1.

The cross-plate 25 has a pair of supporting parts 7*a* and 7*b* projecting therefrom. These supporting parts 7*a* and 7*b* are disposed in positions corresponding to the hands 6*a* and 6*b* of the doll body 1 and fit into the through holes 61*a* and 61*b* in the hands 6*a* and 6*b*.

Also, footplates 26*a* and 26*b* are provided adjacent to the pillars 24*c* and 24*d*. The feet 16*a* and 16*b* of the doll body 1 are placed on these footplates 26*a* and 26*b*.

The box 3 is made of a transparent material, and as shown in FIG. 1 is made up of a base part 31 and a cover part 32. The cover part 32 is pivotally attached to the base part 31 by shaft portions 33 provided on side surfaces of the base part 31.

Next, the operation of this preferred embodiment will be described.

Figure 4:
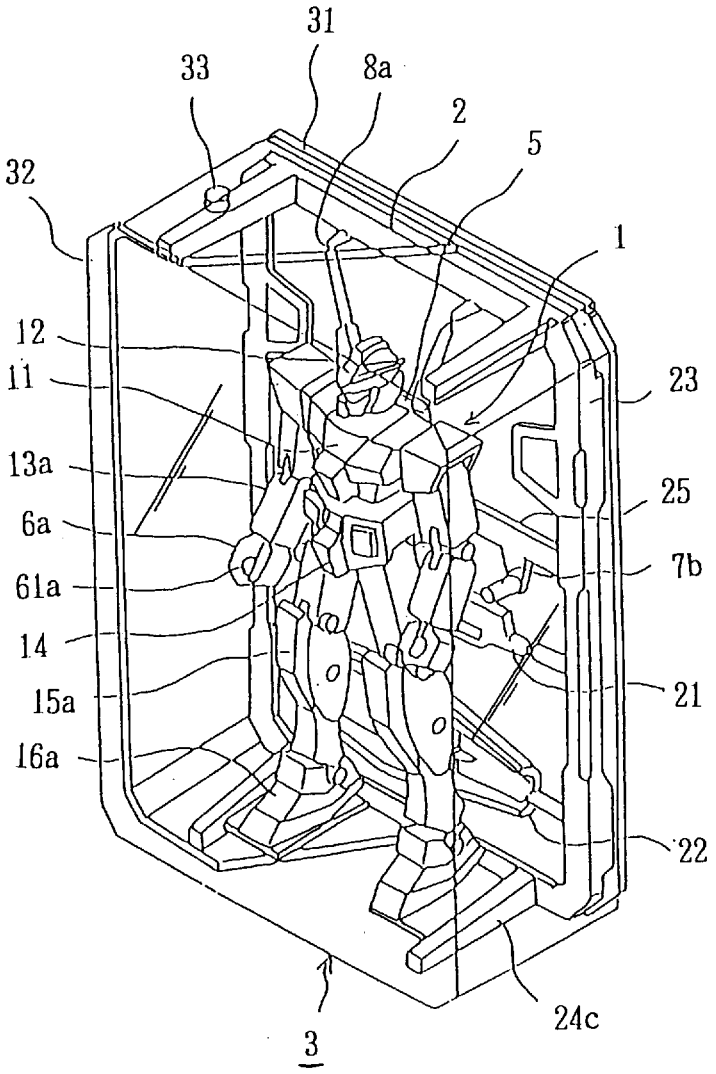
FIG. 4 is a perspective view of a doll body according to the invention housed in the case.

First, the state of the doll toy of the preferred embodiment when it is being transported during its distribution as a commercial product will be described with reference to FIG. 4.

The part 5 is formed integrally with the runner 2, the projection 51 is provided on the part 5, and the projection 51 is fitted into the fitting hole provided in the boss 41 inside the opening 4 in the doll body 1 without the part 5 being cut from the runner 2. As a result, the whole of the runner 2 having the part 5 integral therewith is fitted to the back side of the doll body 1. At this time, the feet 16*a* and 16*b* of the doll body 1 are placed on the footplates 26*a* and 26*b* of the runner 2. Accordingly, by the projection 51 of the part 5 being fitted into the fitting hole in the boss 41 in the doll body 1 and the feet 16*a* and 16*b* of the doll body 1 being placed on the footplates 26*a* and 26*b*, the doll body 1 is positioned and held in a predetermined position on the runner 2.

The pillars 24*a*, 24*b*, 24*c* and 24*d* provided projecting to a predetermined height from the four corners of the frame 23 of the runner 2 act as positioning members for positioning the runner 2 in the box 3. That is, when the doll body 1 and the runner 2 are put into the box 3 with the doll body 1 positioned in its predetermined position on the runner 2, the presence of the pillars 24*a*, 24*b*, 24*c* and 24*d* makes it possible for the doll body 1 and the runner 2 to be housed in the box 3 in a properly positioned state without any special cushioning members or holding members having to be used. As a result, the doll body 1 and its accessories do not collide and become damaged inside the box 3 due to vibration in carriage and can therefore be transported reliably and safely.

Figure 5:
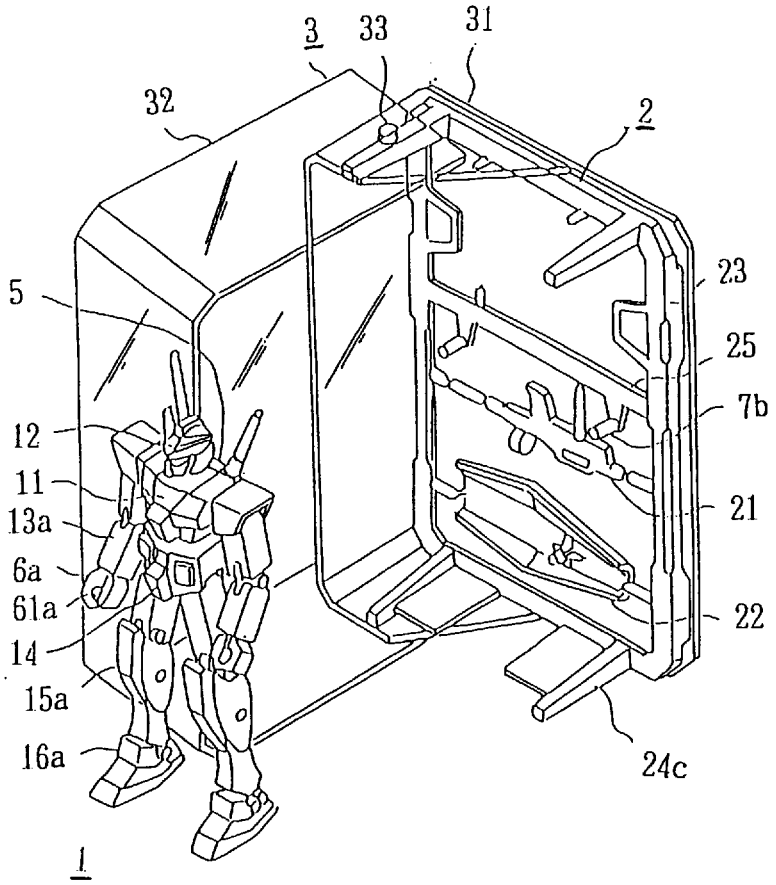
FIG. 5 is a perspective view of a doll body according to the invention removed from the case.

Next, the operation of the doll toy when it is being played with will be described with reference to FIG. 5.

By removing the projection 51 of the part 5 from the fitting hole in the boss 41 in the doll body 1, the doll body 1 can be easily removed from the runner 2.

Because the part 5 is attached to the frame 23 by way of the gate portions 8*a*, 8*b* and these gate portions 8*a*, 8*b* are formed as part of the same member as the part 5 and are thin and narrow and can therefore be easily cut, by cutting the gate portions 8*a*, 8*b* the part 5 can be easily removed from the runner 2.

By fitting the projection 51 of the part 5 into the fitting hole in the boss 41 in the doll body 1, the part 5 removed from the runner 2 can be easily attached to the back side of the doll body 1 to ready the doll body 1 to be played with.

Figure 6:
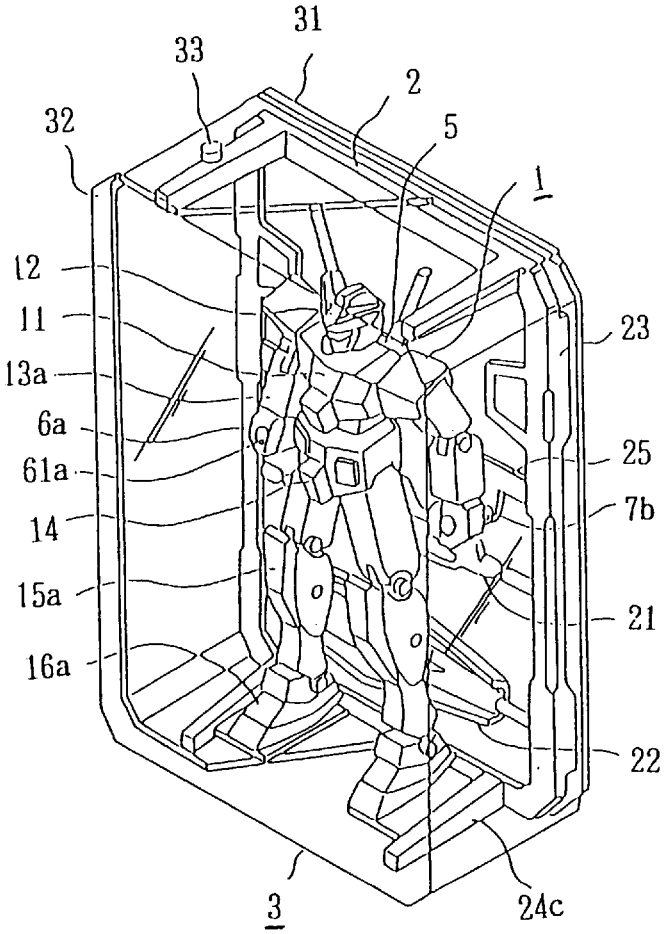
FIG. 6 is a perspective view of a doll body according to the invention rehoused in the case.

Next, the operation of the preferred embodiment when the doll body is being put away after being played with will be explained with reference to FIG. 6.

After the part 5 has been fitted to the doll body 1, as described above, and the toy optionally has been played with, the doll body 1 can be fitted in its predetermined position on the runner 2 by the support part 7*a* being fitted into the through hole 61*a* in the hand 6*a* and the support part 7*b* being fitted into the through hole 61*b* in the hand 6*b*. At this time, because the feet 16*a* and 16*b* of the doll body 1 are placed on the footplates 26*a* and 26*b* of the runner 2, the doll body 1 is fitted to and held on the runner 2 with certainty. When the doll body 1 thus fitted to the runner 2 is put into the box 3, because the box 3 is made of a transparent material the doll body 1 can be put on display on a desk or the like while it is housed in the box 3.

In the above description of how the doll body is prepared for being played with, a case wherein only the part 5 was fitted to the doll body 1 was described; however, the parts 21 and 22 can also be fitted to the doll body 1 before it is played with.

That is, the part 21 can be easily removed from the runner 2 by cutting the gate portions 8*c*, 8*d* and 8*e*, and the part 22 can be easily removed from the runner 2 by cutting the gate portions 8*f* and 8*g*. The part 21 removed from the runner 2 can be attached to the hand 6*a* of the doll body 1 by fitting the mating projection 21*a* of the part 21 into the through hole 61*a* in the hand 6*a*. The part 22 removed from the runner 2 can be attached to the hand 6*b* of the doll body 1 by fitting the mating projection 22*a* of the part 22 into the through hole 61*b* in the hand 6*b*. In this way, not only can the part 5 be attached to the back side of the doll toy but the part 21 and the part 22 can be attached to the hands 6*a* and 6*b* of the doll body 1 and played with, and the added value of the product is therefore increased.

Although in the preferred embodiment described above the doll body 1 is made of a hard synthetic resin, it may alternatively be made by integrally molding a soft synthetic resin. Also, instead of being a cassette tape shaped box as in the preferred embodiment described above, the box 3 may alternatively be made of some other suitable material such as cardboard and may be of some other shape.

As described above, according to the first means provided by the invention, parts attached to the back side of a doll body can be fitted to and removed from the doll body without being removed from the runner while still integral with the runner. As a result, when the doll body is housed in a box and transported, the doll body can be attached to the runner by way of the parts on its back side and the runner can be used as a member for positioning the doll body in the box. Also, the doll body can be easily removed from the runner in a complete state with the back parts attached thereto by cutting the gate portions of the part on the runner.

In this way, it is possible to use the runner, created when the parts were molded, as a positioning and holding member for housing the doll body in the box. As a result, it is not necessary to fix the doll body to a separate cardboard stand with rubber bands or to provide separate cushioning members made of styrene foam or the like. There also are the benefits that the number of parts and assembly manhours can be reduced and cost can therefore be reduced.

Also, because through holes are provided in the hands of the doll body, if a part resembling a machine gun and a part resembling a shield or the like having mating projections which can fit into the through holes are provided as accessories integral with the runner, these parts can be removed from the runner by cutting the gate portions and also attached to the hands of the doll body for playing. There also is the benefit that the added value of the product can thereby be increased.

According to the second means provided by the invention, parts attached to the back side of a doll body can be fitted to and removed from the doll body without being removed from the runner while still integral with the runner. As a result, when the doll body is housed in a box and transported, the doll body can be attached to the runner by way of the parts on its back side and the runner can be used as a member for positioning the doll body in the box. Also, the doll body can be easily removed from the runner in a complete state with the back part attached thereto by cutting the gate portions of the parts on the runner. After that, when the doll body is attached to the runner again in order to put it back in the box, by fitting the support parts separately formed on the runner into the through holes provided in the hands of the doll body, the doll body can be held in its prescribed position on the runner. In this way, it is possible to use the runner, created when the parts are molded, as a positioning and holding member for housing the doll body in the box. As a result, it is not necessary to fix the doll body to a separate cardboard stand with rubber bands or to provide separate cushioning members made of styrene foam or the like. There also are the benefits that the number of parts be reduced but also assembly manhours can be reduced and cost can therefore be reduced.

Also, because through holes are provided in the hands or the doll body, if a part resembling a machine gun and a part resembling a shield or the like having mating projections which can fit into the through holes are provided as accessories integral with the runner, these parts can be removed from the runner by cutting the gate portions and can be attached to the hands of the doll body for playing. There also is the benefit that the added value of the product can thereby be increased.

What is claimed is:

1. An apparatus comprising:

a toy doll comprising a plurality of parts; and a storage unit comprising a runner and at least one gate removably connecting a first one of said plurality of parts of said toy doll to said runner, wherein said at least one gate and said first one of said plurality of parts of said toy doll are integrally formed with said runner and all others of said plurality of parts of said toy doll are not integrally formed with said runner, and said first one of said plurality of parts can be removed from said runner by severing said at least one gate connecting said first one of said plurality of parts to said runner.

2. The apparatus of claim 1, wherein said first one of said plurality of parts of said toy doll comprises a back portion of said toy doll.

3. The apparatus of claim 1, wherein said plurality of parts of said toy doll include hands having through holes, and said storage unit comprises support members integrally formed with said runner for removably engaging said through holes, thereby supporting said toy doll in said storage unit.

4. A transportable packaging apparatus retaining a toy doll in a substantially stable orientation within said packaging apparatus, said packaging apparatus comprising:

a toy doll and frame;

at least one doll part adapted to be removably attachable to said toy doll;

wherein said frame and said at least one doll part are integrally formed as one continuous piece, separate from said toy doll, and wherein said toy doll can be stably attached to said frame by attaching said toy doll to said at least one doll part, thereby retaining said toy doll in said packaging apparatus.

5. The transportable packaging apparatus of claim 4 further comprising at least one gate portion connecting said at least one doll part to said frame, said at least one gate portion being integrally formed with said frame and said at least one doll part as one continuous piece.

6. The transportable packaging apparatus of claim 5 wherein said at least one doll part can be separated from said frame by severing said at least one gate portion connecting said at least one doll part to said frame, thereby allowing said at least one doll part to be removed from said packaging apparatus.

7. The transportable packaging apparatus of claim 5 wherein said at least one doll part comprises a projection for linking said at least one doll part with said toy doll.

8. The transportable packaging apparatus of claim 4 further comprising at least one accessory for use with said toy doll, said at least one accessory being removably connected to said frame, wherein said at least one accessory, said frame and said at least one doll part are integrally formed as one continuous piece, separate from said toy doll.

9. The transportable packaging apparatus of claim 4 wherein said at least one doll part comprises a back plate for said toy doll.

10. The transportable packaging apparatus of claim 4 further comprising a footplate connected to said frame, wherein a foot of said toy doll rests on said footplate when said toy doll is attached to said frame through said at least one doll part.

11. The transportable packaging apparatus of claim 4 further comprising a display door which is hingedly mounted to said frame;

wherein said display door is rotatable between an open position allowing said toy doll to be attached to said frame and remove therefrom, and a closed position.

12. A toy doll comprising:

a body including at least one body part that is adapted to be removably attachable to said body; and a storage unit including a runner;

wherein said runner and said at least one doll part are integrally formed as one continuous piece, separate from said body, and wherein said body can be stably attached to said frame by attaching said toy doll to said at least one doll part, thereby retaining said toy doll in said storage unit.

13. The toy doll of claim 12 wherein said at least one body part can be separated from said runner, allowing said at least one body part to be attached to said body after said body is removed from said packaging apparatus.

14. The toy doll of claim 13 wherein said runner further includes a pair of support parts connected thereto;

wherein said body further includes a pair of hands, each defining a through hole adapted to receive one of said pair of support parts; and wherein said body, having been removed from said storage unit and having said body part attached thereto, can be stably stored in said storage unit by positioning said body on said runner such that each of said pair of through holes received a corresponding one of said support parts.

* * * * *